United States Patent [19]

Philips et al.

[11] Patent Number: 4,520,999

[45] Date of Patent: Jun. 4, 1985

[54] COMBINATION OF A HOISTDRUM AND HOISTCABLE FOR A WINCH

[76] Inventors: Franciscus M. Philips, Vermeerstraat 30, Alkmaar; Koenraad A. de Jong, Planetenlaan 56, Opmeer, both of Netherlands

[21] Appl. No.: 585,046

[22] Filed: Mar. 1, 1984

[30] Foreign Application Priority Data

Mar. 14, 1983 [NL] Netherlands ..... 8300912

[51] Int. Cl.[3] ..... B66D 1/00; B66D 1/26

[52] U.S. Cl. ..... 254/278; 254/266

[58] Field of Search ..... 254/278, 266, 279, 280, 254/281, 282, 283, 284, 285, 286, 287, 288, 290, 291, 292; 242/84.1 L, 107.1

[56] References Cited

U.S. PATENT DOCUMENTS 2,802,638 8/1957 Ireland ..... 254/278 X
2,957,641 10/1960 Humphrey ..... 242/84.1 L
3,061,234 10/1962 Morey ..... 242/107.1
3,144,218 8/1964 Tepe ..... 242/107.1

FOREIGN PATENT DOCUMENTS 642259 1/1979 U.S.S.R. ..... 254/278
656958 4/1979 U.S.S.R. ..... 254/278

*Primary Examiner*—Stuart S. Levy
*Assistant Examiner*—Katherine Jaekel
*Attorney, Agent, or Firm*—Pollock, Vande Sande and Priddy

[57] ABSTRACT

A combination of a hoist drum and cable for a winch, in which the hoist cable is connected past its point of anchorage to the drum to a thinner auxiliary (breaking) cable, which is wound onto a spool within the drum, and an arrangement is provided to release the hoist cable from its anchorage to the drum so that, when the hoist cable is unwound from the drum and released from its anchorage to the drum, it may take the auxiliary cable with it, thereby unwinding it from its spool.

10 Claims, 1 Drawing Figure

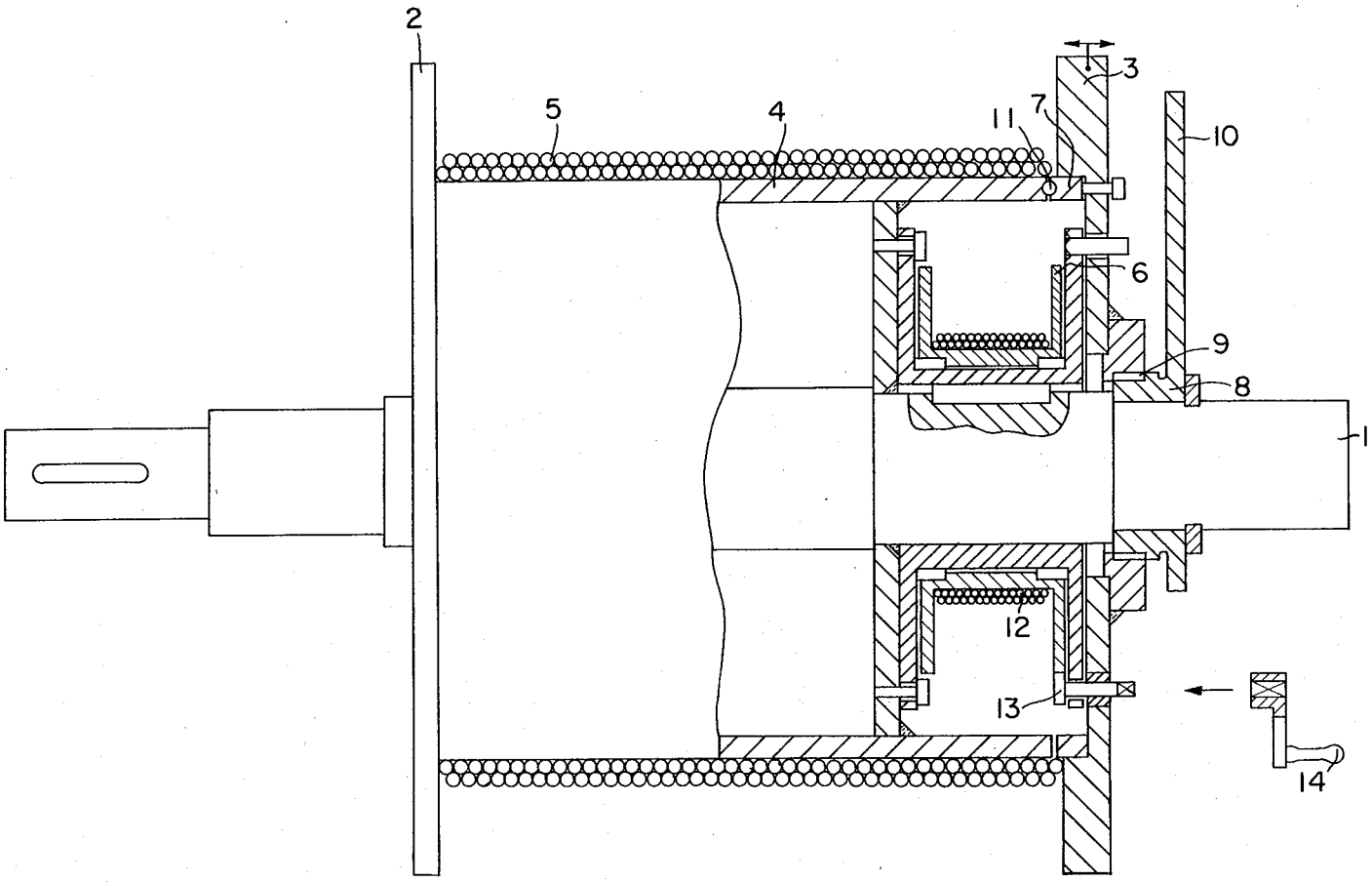
1
2
3
4
5
6
7
8
9
10
11
12
13
14

COMBINATION OF A HOISTDRUM AND HOISTCABLE FOR A WINCH

The present invention relates to a combination of a hoist drum and cable for a winch, in which the drum is mounted for rotation and is formed by two spaced side flanges between which a cylindrical wall is present forming the winding surface for the cable, which one end of has been fixed to the drum.

Such a combination is generally known.

The known combination has the drawback that the hoist cable, after being unwound from the drum, is not released therefrom but, by exceeding a certain load, has to been torn free by this load from its anchorage in the drum. When the cable is released in this way, it might easily wind itself fixedly around the hoisting device of crane after which the same might be torn from its support. Such events may occur, for example, at cranes mounted on a platform for off-shore oilwinning, and where the cranes are used to unload the supply-boats. In stormy weather, a supply-boat being unloaded by a crane mounted on the platform may drift away and pull the crane with it free from the platform when the cable has been completely unwound from the drum.

It is an object of the present invention to obviate this disadvantage of the known combination of hoist drum and -cable.

According to the invention the hoist cable is connected past its bedding or fixing point in or to the drum to a thinner auxiliary (breaking) cable, which is wound onto a spool mounted within the drum in coaxial alignment therewith, and further means are provided to release the hoistcable from its fixing to the drum, such, that the hoist cable, after being unwound from the drum and released from its anchorage to the drum, will take the auxiliary cable with it and thereby unwind the same from its spool.

So, in the combination of drum and cable according to the invention, there is a play present after the unwinding of the hoist cable from the drum and after releasing the hoist cable from its anchorage to the drum, which play is offered by the auxiliary cable which may be partly or completely unwound from its spool. In the event that the reserve or spare length offered by the auxiliary cable is not sufficient to bridge, together with the hoist cable, the distance between the crane on the platform and the supply-boat being unloaded, the latter will cause the auxiliary cable to break without there being any danger that the crane would be pulled from the platform. The spool carrying the auxiliary cable may be mounted within the drum in several manners.

In an embodiment of the invention the spool may rotate freely with respect to the drum.

Favourably the spool may be provided with driving means to rotate the spool to wind the auxiliary cable onto it.

When the auxiliary cable has been paid out in an emergency, it may be wound again onto the spool, thereby bringing back the end of the hoist cable to the drum to be fixed again to or into its anchorage.

Anchoring the end of the hoist cable to or into the drum may be carried out in several ways.

In a preferred embodiment of the invention a side flange of the drum, with an adjacent portion of the cylindrical wall (forming the winding surface for the hoist cable) is separated from the remaining drum portion along a plane extending perpendicularly to the axis of rotation of the drum, so that this side flange and the adjacent wall portion may be displaced axially with respect to the said remaining drum portion to fix the end of the hoist cable between both drum portions or to release said end therefrom. When, in this embodiment of the invention, the end of the hoist cable is released from its anchorage by moving the drum portions axially away from each other, there is formed at the same time an annular slot in the drum wall, through which the auxiliary cable may pass when it is pulled from its spool by the released end of the hoist cable.

In a further embodiment of the invention, the axially displacable drum portion is supported by the drum shaft by means of a sleeve, which is freely rotatable around and axially locked with respect to the drum shaft, said sleeve being provided with a screwthread cooperating with a screwthread present on the axially displacable drum portion, such that when the sleeve is slowed down during unwinding the hoist cable, the drum portion supported by the sleeve is moved away from the remaining drum portion, thereby releasing the hoist cable from its anchorage and forming the annular slot through which the auxiliary cable may pass.

Advantageously the sleeve may be provided with a lever by means of which it may be rotated to move the drum portion carried by the sleeve axially to or from the other drum portion.

In normal operation, the sleeve and lever will rotate equally together with the drum and spool therein.

When, however, the operator believes danger is present due to the supply-boat drifting away from the platform, he may simply block the movement of the lever thereby causing the drum portion carried by the sleeve to be moved away from the other remaining drum portion, so that the anchored end of the hoist cable is released from the drum and the annular slot is formed in the drum wall, through which the auxiliary cable may pass when it is pulled on by the hoist cable and unwound from its spool. Preferably both drum portions are prevented from rotating with respect to each other. Also the drum portion which is not axially displaceable along its supporting shaft preferably is keyed to its supporting shaft.

The invention is illustrated by way of example in the accompanying drawing.

As is shown in the drawing, the hoist drum, consisting of two spaced side flanges 2 and 3, and therebetween a cylindrical wall 4, forming the winding surface for the hoist cable 5, is mounted for rotation on the shaft 1.

Within the cylindrical wall 4 is mounted the spool 6, which is freely rotatable around and with respect to the shaft 1 and the drum mounted thereon.

The side flange 3 with adjacent wall portion 7 is separated from the remaining wall portion along to a plane extending perpendicularly to the driving shaft 1. The side flange 3 with adjacent wall portion 7 is supported on the shaft 1 by means of the sleeve 8, which is provided with a screwthread 9 cooperating with a complementary screwthread on the side flange 3.

The sleeve 8 further is provided with a lever 10 by means of which the not axially displacable sleeve 8 may be rotated with respect to the shaft 1 to move the side flange 3 with adjacent wall portion 7 to or from the remaining drum portion.

In normal operation the wall portion 7 and adjoining side flange 3 contacts the wall portion 4 of the remaining drum portion so that the end of the hoist cable is firmly fixed between both wall portions at the point of anchorage 11.

When, in the event of an emergency, and during unwinding the hoist cable from the drum, the lever 10 is arrested or slowed down with respect to the rotating drum, the sideflange 3 with adjoining wall portion 7 is moved, as seen in the drawing, to the right thereby releasing the end of the hoist cable from its anchorage 11, while, at the same time, an annular slot is formed between both wall portions, through which the auxiliary cable may pass when being pulled on by the end of the hoist cable from its spool 6. At one of its side flanges the spool 6 is provided with a gearing meshing with a pinion 13, which may be rotated by means of a crank having a handle 14 to wind afterwards the auxiliary cable onto its spool 6 again, thereby bringing the end of the hoist cable back to its point of fixing between both drum portions, after which the flange 3 is moved back again towards the remaining drum portion thereby fixing the end of the hoist cable between both wall portions. The movement backwards of the flange 3 with adjacent wall portion 7 may also be carried out by rotating the lever 10 with respect to the shaft 1 and both drum portions mounted thereon.

We claim:

1. In a winch assembly, a hoist drum comprising a pair of spaced side flanges having a cylindrical wall therebetween, a shaft mounting said drum for rotation, an elongated main cable wrapped about the exterior of said cylindrical wall between said side flanges, said main cable having an outer end which is adapted to be displaced relative to the axis of rotation of said drum upon rotation of said drum and an inner end which is releasably attached to said drum at an anchorage location that is fixed in position relative to the axis of rotation of said drum, a spool disposed within said cylindrical wall of said drum in coaxial relation to said drum, an auxiliary cable wrapped about said spool, said auxiliary cable being thinner and more readily breakable upon application of tensile forces thereto than said main cable, said auxiliary cable having an outer end of which is attached to said inner end of said main cable, and means for selectively releasing said inner end of said main cable from said anchorage location when said main cable is about to be completely payed out from said drum thereby to free said inner end of said main cable from its attachment to said drum and to permit said main cable to be payed out further and to unwind said auxiliary cable from said spool so as to draw the outer end of said auxiliary cable together with the inner end of said main cable away from said drum.

2. The structure of claim 1 wherein said spool is mounted for rotation independent of the rotation of said drum.

3. The structure of claim 2 including driving means for selectively rotating said spool relative to said drum to wind said auxiliary cable onto said spool.

4. The structure of claim 1 wherein said means for selectively releasing said inner end of said main cable from said anchorage location comprises means for selectively displacing one of the side flanges of said drum relative to the other of said side flanges along the axis of said drum, said anchorage location comprising means for forcibly engaging said inner end of said main cable when said one of said side flanges is in a first axial position relative to said other side flange and for disengaging said inner end of said main cable from said drum when said one of said side flanges is in a second axial position relative to said other side flange.

5. The structure of claim 4 wherein said pair of side flanges are closer to one another in said first axial position than in said second axial position.

6. The structure of claim 5 wherein said one of said side flanges is attached to a portion of said cylindrical wall which is adapted to move axially, together with said one of said side flanges, away from the remainder of said cylindrical wall and away from said other of said side flanges as said one of said side flanges is displaced from said first axial position to said second axial position, said inner end of said main cable being trapped between closely adjacent facing surfaces of said portion of said cylindrical wall and said remainder of said cylindrical wall in said first axial position of said one of said side flanges, the said adjacent facing surfaces being more widely spaced from one another when said one of said flanges is displaced to said second axial position to free the trapped inner end of said main cable and to provide an annular slot in said cylindrical wall through which the auxiliary cable may pass from said spool.

7. The structure of claim 4 or 6 including a sleeve mounted for free rotation about said shaft of said drum at a fixed axial position on said shaft, said sleeve including means defining a screw thread which is in thread engagement with a complementary screw thread defined on means attached to said one of said side flanges, rotation of said sleeve relative to said one of said one of said side flanges being operative to cause said engaged threads to displace said one of said side flanges axially relative to the other of said side flanges.

8. The structure of claim 7 including means attached to said sleeve for rotating said sleeve about said shaft.

9. The structure of claim 6 including means for locking said portion of said cylindrical wall against rotation relative to said remainder of said cylindrical wall.

10. The structure of claim 6 wherein said remainder of said cylindrical wall and the said other side flange attached thereto are keyed to said shaft for rotation with said shaft.

* * * * *